US006361477B1

(12) United States Patent
Kolda

(10) Patent No.: US 6,361,477 B1
(45) Date of Patent: Mar. 26, 2002

(54) HEAT DISSIPATING ARRANGEMENT FOR A RESISTANCE UNIT IN AN EXERCISE DEVICE

(75) Inventor: Clint D. Kolda, Cottage Grove, WI (US)

(73) Assignee: Graber Products, Inc., Madison, WI (US)

( * ) Notice: Subject to any disclaimer, the term of this patent is extended or adjusted under 35 U.S.C. 154(b) by 0 days.

(21) Appl. No.: 09/587,413

(22) Filed: Jun. 5, 2000

(51) Int. Cl.[7] ..... A63B 22/06
(52) U.S. Cl. ..... 482/61; 482/112; 188/290
(58) Field of Search ..... 482/61, 62, 63, 482/112, 111, 57, 58, 59; 188/290, 293, 294, 113; 198/58.4, 58.42, 58.43

(56) References Cited

U.S. PATENT DOCUMENTS

| | | | | |
|---|---|---|---|---|
| 2,504,007 A | | 4/1950 | Declerco | |
| 3,373,992 A | | 3/1968 | Ludeman | |
| 3,494,616 A | | 2/1970 | Parsons | |
| 4,645,199 A | | 2/1987 | Bloemendaal | |
| 5,026,047 A | * | 6/1991 | Kosecoff | 482/59 |
| 5,051,638 A | | 9/1991 | Pyles | |
| 5,183,453 A | | 2/1993 | Yamashiro | |
| 5,195,936 A | | 3/1993 | Mao | |
| 5,247,853 A | * | 9/1993 | Dalebout | 74/572 |
| 5,542,507 A | | 8/1996 | Warchocki et al. | |
| 5,611,759 A | | 3/1997 | Zeh et al. | |
| 5,674,158 A | | 10/1997 | Navas | |
| 5,792,030 A | | 8/1998 | Sartore | |
| 5,916,068 A | | 6/1999 | Chisholm et al. | |
| 5,944,637 A | | 8/1999 | Stickler et al. | |

FOREIGN PATENT DOCUMENTS

| | | |
|---|---|---|
| EP | 0 323 056 | 7/1989 |

* cited by examiner

*Primary Examiner*—Stephen R. Crow
(74) *Attorney, Agent, or Firm*—Boyle, Frederickson, Newholm, Stein & Gratz, S.C.

(57) ABSTRACT

A resistance unit for an exercise device includes a resistance mechanism, such as a fluid-type resistance mechanism, located within a housing. A rotatable shaft is interconnected with an input member. An input roller is engaged with the shaft, and is adapted for rotation in response to a force exerted by a person during exercise, such as rotation of a bicycle wheel. The resistance mechanism imparts resistance through rotation of the shaft, which results in resistance to the external force, such as rotation of the bicycle wheel. A combination fan/flywheel member is mounted to the shaft. The combination fan/flywheel member maintains inertia of the rotating shaft, and includes blade structure which directs air toward the housing of the resistance mechanism upon rotation of the combination fan/flywheel member along with the shaft. The combination fan/flywheel member includes a series of radially spaced blades which extend between and interconnect an inner hub section and an outer ring section defined by the combination fan/flywheel member. The housing of the resistance mechanism is constructed so as to present spaced cooling fins facing the combination fan/flywheel member, to facilitate the dissipation of heat from the housing by movement of air by the combination fan/flywheel member onto the housing during operation. Cooling of the housing prevents adverse effects associated with heat buildup, e.g. a loss of fluid viscosity and shortened seal life in a fluid-type resistance unit.

19 Claims, 3 Drawing Sheets

28
46
50
48
52
34
36
62
58
56
24
32
30
126
124
118
123
102
94
96
98
66
80
108
106
70
74
114
116
76
92
72
82
78
68

HEAT DISSIPATING ARRANGEMENT FOR A RESISTANCE UNIT IN AN EXERCISE DEVICE

BACKGROUND AND SUMMARY OF THE INVENTION

This invention relates to a resistance unit for an exercise device such as a bicycle trainer or the like.

Exercise devices commonly utilize resistance units for providing resistance to a person performing an exercise. Several types of resistance mechanisms have been developed for use in resistance units, and include magnetic, fluidic and electronics resistance mechanisms. Typically, the resistance mechanism is located within a housing and is interconnected with an input member which is subjected to a force by a user during exercise, with the input member functioning to impart rotation to the resistance mechanism within the housing.

In some types of exercise devices, a significant amount of heat can buildup in the housing and have an adverse impact on overall performance of the resistance mechanism. For example, in a fluid-type resistance mechanism, build up of heat within the housing can effect the viscosity of the fluid and thereby the resistance imparted by the resistance mechanism. In addition, heat buildup can have a negative impact on the life of the seal which functions to maintain the fluid within the housing. Buildup of heat can also adversely effect the overall performance and life of other types of resistance mechanisms, such as magnetic or electronic resistance mechanisms.

Many types of resistance units, including those incorporated in bicycle trainers, utilize a shaft which is rotatable in response to an external force exerted by a person during exercise. The shaft rotates in response to the external force, and rotation of the shaft is resisted by the resistance mechanism. In a bicycle trainer, a roller is commonly fixed to the shaft and engaged with the rear wheel of the bicycle for driving the roller in response to rotation of the bicycle wheel. In the past, the shaft has been supported in a manner tending to allow the shaft to wobble or to slide back and forth along its longitudinal axis.

It is an object of the present invention to provide a resistance unit which substantially eliminates problems associated with heat buildup in the resistance mechanism. Another object of the invention is to provide such a resistance unit which takes advantage of existing structure in order to prevent buildup of heat in the resistance mechanism. Yet another object of the invention is to provide such a resistance unit which utilizes energy imparted by the exerciser to cool the housing of the resistance unit. A still further object of the invention is to provide a cooling arrangement which is suitable for use in connection with various types of resistance mechanisms, such as fluidic, magnetic or electronic resistance units. Yet another object of the invention is to provide such a resistance unit which is relatively simple in its components and construction, yet which effectively prevents buildup of heat in the resistance mechanism. Yet another object of the invention is to provide such a resistance unit which ensures consistent positioning of the shaft relative to the housing and to the shaft supporting components of the resistance unit.

In accordance with one aspect of the invention, a resistance unit for an exercise device includes a housing defining an interior, and a shaft having a first portion located within the interior of the housing and a second portion located exteriorly of the housing. The shaft is interconnected in the exercise device so as to rotate in response to application of an external force by a person performing an exercise. A resistance mechanism is interconnected with the first portion of the shaft and is located within the interior of the housing for providing resistance to the person's movements. An inertial member is interconnected with the second portion of the shaft and is rotatable therewith. The inertial member includes a blade arrangement which is operable to direct ambient air toward the housing upon rotation of the inertial member by rotation of the shaft. Such movement of air toward the housing is operable to prevent buildup of heat within the housing caused by operation of the resistance mechanism. In one embodiment, an input member is engaged with the second portion of the shaft. The input member may be in the form of a roller member fixed to the shaft and located between the housing and the inertial member. The resistance unit may be incorporated in a bicycle trainer, and the roller member may be engageable with a wheel of a bicycle for imparting rotation to the shaft in response to rotation of the bicycle wheel.

The inertial member is preferably in the form of a combination flywheel and fan member mounted to the second portion of the shaft and rotatable with the shaft. The combination flywheel and fan member may be constructed so as to include a hub section secured to the second portion of the shaft and an annular outer ring section located outwardly of the hub section. The blade arrangement is located between the hub section and the annular outer ring section. The blade arrangement may be in the form of a series of blades extending between and interconnecting the hub section and the outer ring section, with the blades being spaced apart from each other so as to define an open area between adjacent blades.

The shaft extends along a longitudinal axis, and the combination flywheel and fan member is spaced from the housing. The blade arrangement is constructed and arranged so as to move air laterally in a direction parallel to the longitudinal axis of the shaft toward the housing, upon rotation of the shaft and the combination flywheel and fan member. In a construction wherein an input member is located between the housing and the combination flywheel and fan member, the blade arrangement is operable to move air past the input member toward the housing.

In accordance with another aspect of the invention, an improvement in an exercise device incorporates a rotatable fan arrangement interconnected with the resistance mechanism and located exteriorly of the housing within which the resistance mechanism is contained. The fan arrangement is constructed and arranged so as to rotate in response to movement of a person performing an exercise, and to direct air toward the housing of the resistance mechanism. Further details of this aspect of the invention are as set forth above.

Another aspect of the invention contemplates a bicycle trainer having a frame adapted to support a rear wheel of a bicycle, in combination with a resistance unit mounted to the frame. The resistance unit includes a housing, a rotatable input member engageable with the rear wheel of the bicycle, and a resistance mechanism interconnected with the rotatable input member and located within the housing. An inertial member is interconnected with the rotatable input member and located exteriorly of the housing, and the inertial member includes blade structure which is operable upon rotation of the inertial member to direct air toward the housing. Again, additional details of this aspect of the invention are as set forth above.

Yet another aspect of the invention involves an improved arrangement for mounting a shaft to a support structure in a resistance unit. The shaft is interconnected with an input member, such as a roller, and the support structure includes a pair of spaced support areas. A bearing member is engaged with each support area for rotatably mounting the shaft to the support structure. The resistance unit further includes a housing defining an interior within which a resistance mechanism is located. The shaft extends into the interior of the housing for connection to the resistance mechanism, through an opening in the housing. A third bearing member is engaged with the housing at a location spaced from and adjacent one of the bearing members engaged with one of the support areas of the support structure. Engagement structure is interposed between the housing and the support structure for locating the housing relative to the support structure. The third bearing member is operable to fix the position of the shaft relative to the housing, to prevent shaft wobble. In a fluid-type resistance mechanism, the third bearing member is located adjacent a seal engaged with the housing and with the shaft, and the third bearing member functions to ensure alignment of the shaft with the seal.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
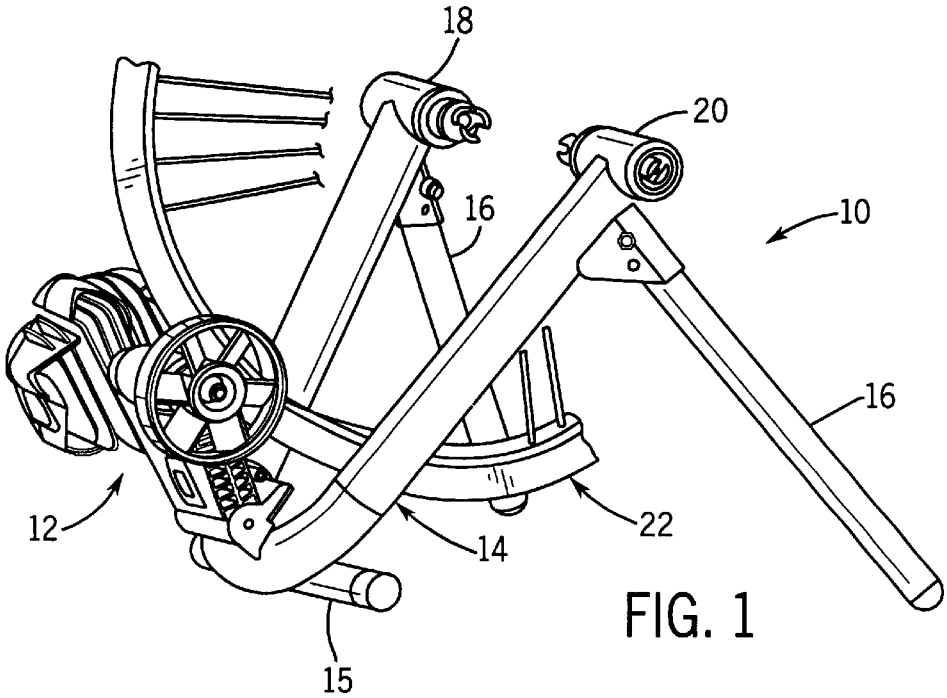
FIG. 1 is an isometric view of a bicycle trainer incorporating a resistance unit constructed according to the invention.

Referring to FIG. 1, a bicycle trainer 10 incorporates a resistance unit 12 constructed in accordance with the present invention. In addition to resistance unit 12, bicycle trainer 10 includes a generally U-shaped frame 14, a transverse support member 15 and a pair of legs 16, which are operable in a known manner so as to provide a stable base for bicycle trainer 10. Also in a known manner, bicycle trainer 10 includes a pair of clamps 18, 20 which are operable to engage the hub portion of a rear wheel 22 of a bicycle. The position of one of clamps 18, 20 is fixed, and the other of clamps 18, 20 is movable toward the fixed clamp so as to engage the hub of rear wheel 22 and to securely mount the bicycle to bicycle trainer 10.

Figure 2:
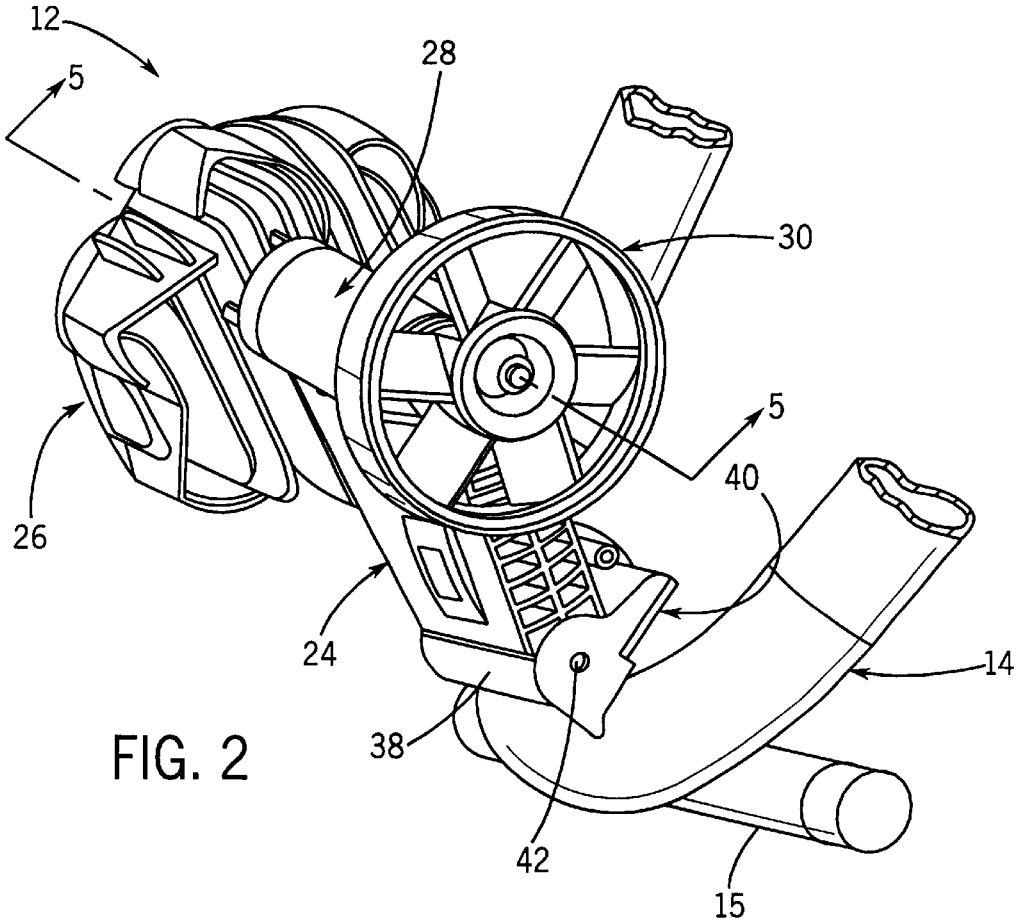
FIG. 2 is an enlarged partial isometric view of the resistance unit incorporated in the bicycle trainer of FIG. 1.

As shown in FIG. 2, resistance unit 12 includes a yoke 24 which is connected to frame 14. In a manner as is known, yoke 24 is pivotable relative to frame 14 and capable of being secured in a fixed location in engagement with rear wheel 22. In addition to yoke 24, resistance unit 12 generally includes a housing 26, a rotatable input member in the form of a roller 28, and an inertial member in the form of a combination fan/flywheel member 30. In a manner to be explained, housing 26 contains a resistance mechanism for providing resistance to rotation of rear wheel 22 upon rotation of rear wheel 22. Combination fan/flywheel member 30 functions as a flywheel so as to simulate normal momentum of a bicycle during operation, to provide a realistic feel to the user during operation. In addition, as will be explained, combination fan/flywheel member 30 is operable to direct air laterally toward housing 26 during use, to prevent buildup of heat within housing 26.

Figures 3, 4:
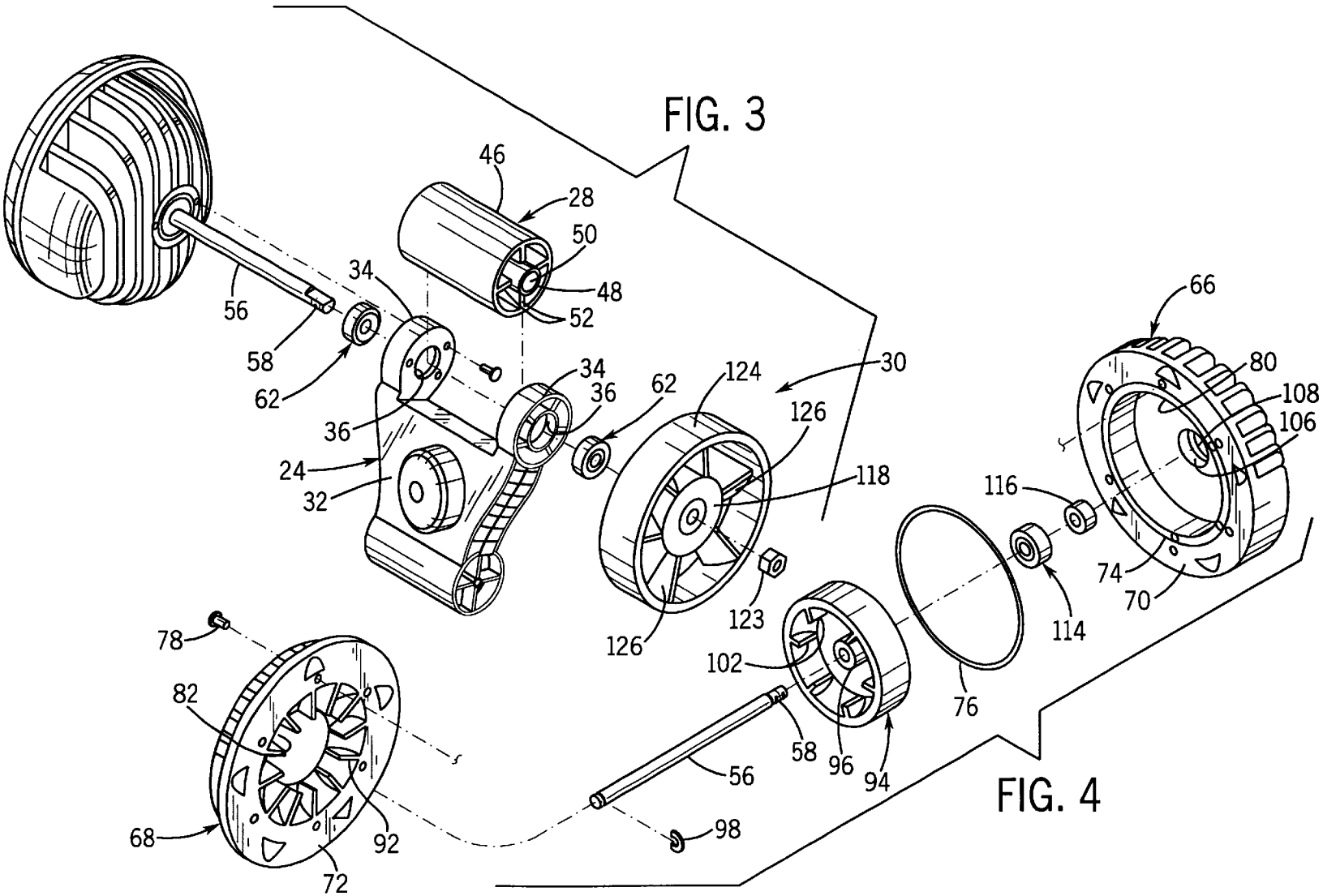
FIG. 3 is an exploded isometric view of certain of the components of the resistance unit of FIGS. 1 and 2.
FIG. 4 is an exploded isometric view illustrating the resistance mechanism incorporated in the resistance unit of FIGS. 1–3.

Referring to FIG. 3, yoke 24 includes a body section 32 and a pair of spaced apart support sections 34 located at the outer end of body section 32. Support sections 34 define aligned apertures 36, and input roller 28 is received within the space located between support sections 34.

As shown in FIGS. 1 and 2, yoke 24 may be mounted to frame 14 by means of a mounting section 38 located at the lower end of yoke body section 32. Mounting section 38 is engaged with a mounting bracket 40 secured to frame 14 at the bottom curved area of frame 14, in a manner as is known. A pivot pin 42 extends through a passage in mounting section 38, and is engaged with mounting bracket 40. With the mounting arrangement as shown and described, yoke 24 is pivotable about a pivot axis defined by pivot pin 42, for movement into and out of engagement with rear wheel 22.

Figure 5:
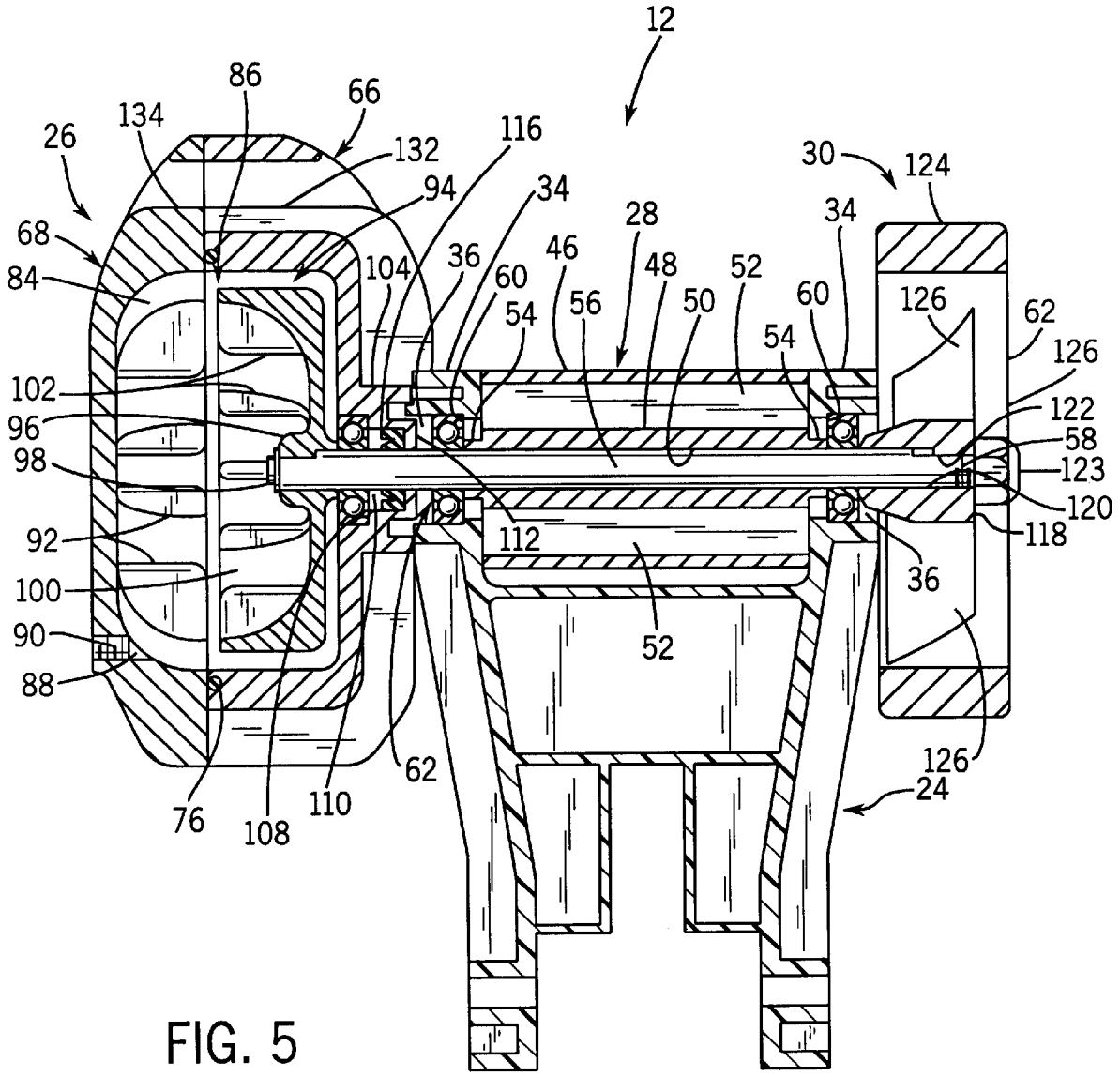
FIG. 5 is a section view taken along line 5—5 of FIG. 2.

As noted previously, input roller 28 is located between yoke support sections 32. Referring to FIGS. 3 and 5, input roller 28 includes an outer cylindrical wall 46 and an inner sleeve 48 defining an axial passage 50. A series of webs 52 extend between and interconnect sleeve 48 with outer cylindrical wall 46. Sleeve 48 defines opposite ends 54, each of which extends laterally past an end of outer cylindrical wall 46. An input shaft 56 extends through passage 50 of sleeve 48. At one end, input shaft 56 defines a threaded section 58. The opposite end of shaft 56 extends into the interior of housing 26 and is interconnected with a resistance mechanism located within housing 26, in a manner to be explained. Shaft 56 and sleeve 48 are nonrotatably secured together, such as by a conventional key and slot mounting arrangement (not shown), such that shaft 56 and input roller 28 rotate as a unit relative to yoke 24.

Aperture 36 in each support section 34 is formed so as to define an inner shoulder 60. A ball-type bearing assembly 62 of conventional construction is located within each aperture 36. Each bearing assembly 62 is engaged within one of apertures 36 such that the outer race of bearing assembly 62 engages shoulder 60 so as to locate each bearing assembly 60 relative to support section 34. The inner race of each bearing assembly 62 is engaged with shaft 56. In this manner, shaft 56 and input roller 28 are rotatably mounted to yoke 24.

Referring to FIGS. 4 and 5, housing 26 is a clamshell assembly including an inner housing section 66 and an outer housing section 68. Housing sections 66, 68 define flat facing engagement surfaces 70, 72, respectively. An annular groove 74 is formed in engagement surface 70 of inner housing section 66, and an O-ring 76 is received within groove 74. Housing sections 66, 68 are adapted to be secured together using a series of fasteners such as 78, which extend through aligned passages formed in housing sections 68, 70. Inner housing section 66 defines a recess 80 extending from engagement surface 70, and outer housing section 68 defines a recess 82 extending from engagement surface 72. When inner housing section 66 and outer housing section 68 are secured together as shown in FIG. 5 using fasteners 78, recesses 80, 82 cooperate to define an internal cavity 84 within which a fluid-type resistance mechanism, shown generally at 86, is located. O-ring 76 provides a fluid-tight seal for maintaining fluid within internal cavity 84. A threaded opening 88 is formed in outer housing section 68 for filling cavity 84 with fluid, and a screw 90 is engageable within opening 88 for maintaining fluid within internal cavity 84.

Resistance mechanism 86 located within internal cavity 84 includes a series of spaced, radial vanes 92 defined by outer housing section 68 and located within recess 82, in combination with a vaned impeller 94 mounted to the end of shaft 56. Impeller 94 includes a hub section 96 having a passage through which the end of shaft 56 extends. A ring 98 is engaged with the end of shaft 56 and with hub section 96, for maintaining the axial position of impeller 94 relative to shaft 56. A key-type mounting arrangement is interposed between shaft 56 and impeller 94, so as to nonrotatably interconnect impeller 94 and shaft 56.

Impeller 94 defines a recess 100 within which a series of vanes 102 are located. In a manner as is known, rotation of input roller 28 in response to rotation of bicycle rear wheel 22 results in rotation of shaft 56 and thereby rotation of impeller 94 within internal cavity 84 of housing 26. Fluid contained within internal cavity 84 acts on vanes 102 of impeller 94 to resist rotation of impeller 94. This resistance to rotation impeller 94 provides resistance to turning of shaft 56 and input roller 28, which in turn resists rotation of bicycle rear wheel 22 to resist the movements of the bicycle operator. The nature and quantity of fluid contained within internal cavity 84 is known in the art.

Inner housing section 66 includes a central boss 104 which engages the outer surface of the adjacent support section 34. Central boss 104 defines a stepped internal configuration, including an outer recess 106 defining an outer shoulder 108, and an inner recess 110 closed by an inner wall 112. A ball-type bearing assembly 114 is located within inner recess 106, and the outer race of bearing assembly 114 is engaged with shoulder 108. A seal 116 is located within inner recess 110, and engages shaft 56 so as to prevent leakage of fluid from housing 26. With this construction, the three-point support of shaft 56 ensures alignment of shaft 56 so as to prevent shaft wobble, and also ensures alignment of shaft 56 with seal 116.

Combination fan/flywheel member 30 includes a central hub section 118 defining a passage 120 and engageable with the inner race of bearing assembly 62. Shaft 56 is adapted to extend through passage 120, and a nonrotatable mounting arrangement is interposed between shaft 56 and combination fan/flywheel member 30. Representatively, passage 120 may include a flat area 122 which engages a corresponding flat area provided on shaft 56, to ensure that combination fan/flywheel member 30 and shaft 56 rotate as a unit.

A nut 123 is engaged with threaded section 58 of shaft 56 and with the outer surface of hub section 118. Nut 123 functions to draw housing 26, yoke 24, input roller 28 and combination fan/flywheel member 30 together into a unitary assembly providing fixed lateral positioning of the various components relative to each other. As can be appreciated, tightening of nut 123 results in engagement of impeller hub section 96 with the inner race of bearing assembly 114, as well as engagement of the inner end of hub section 118 of combination fan/flywheel member 30 with the inner race of bearing assembly 62. The lateral force exerted on the inner race of bearing assembly 62 is transferred to sleeve 48 and thereby to the inner race of the opposite bearing assembly 62. In this manner, bearing assembly 116 and bearing assemblies 62 are preloaded so as to ensure satisfactory operation, and the lateral positioning of the various components is fixed, so as to ensure steady and smooth operation of resistance unit 12.

Combination fan/flywheel member 30 further includes an annular outer ring section 124 spaced outwardly from hub section 118. Blade structure, in the form of a series of radially spaced blade members 126, extend between and interconnect hub section 118 and ring section 124. Blade members 126 are pitched, and cooperate to form a fan-type arrangement which directs air laterally toward housing 26 upon rotation of combination fan/flywheel member 30. While the drawings illustrate a series of four blade members 126 located between hub section 118 and outer ring section 122, it is understood that any number and configuration of pitched blade members may be employed for directing air laterally toward housing 26 upon rotation of combination fan/flywheel member 30.

In operation, rotation of input roller 28 caused by rotation of bicycle rear wheel 22 is transferred through shaft 56 to impeller 94, and rotation is resisted by the presence of fluid within internal cavity 84 so as to impart resistance to rotation of rear wheel 22, as noted previously. Simultaneously, combination fan/flywheel member 30 is rotated, and blade members 126 direct air laterally onto housing 26. The movement of air caused by blade members 26 is in a direction along the longitudinal axis of shaft 56 and across input roller 28. In this manner, the direction of ambient air onto housing 26 functions to prevent buildup of heat within housing 26 which would otherwise be caused by friction resulting from rotation of impeller 94 in the fluid contained within cavity 84. This prevention of the buildup of heat in housing 26 prevents adverse effects which can result from elevated levels of heat, such as a loss of fluid viscosity leading to decreased performance in providing resistance to rotation of bicycle rear wheel 22. In addition, the cooling of housing 26 enhances safety by maintaining housing 26 at a lower temperature than was possible in the past, and can also function to extend the life of seal 116, which can be adversely affected by excessive heat in the fluid contained within internal cavity 84.

Inner and outer sections 66, 68, respectively, of housing 26 are provided with fins 128, which function to radiate heat within internal cavity 84 outwardly. The majority of the fin surface area is associated with inner housing section 66, which is exposed to the moving air directed toward housing 26 by combination fan/flywheel member 30. With this arrangement, the majority of heat is transferred to the area of housing 26 facing combination fan/flywheel member 30 so as to maximize the cooling effect resulting from such movement of air toward housing 26.

In addition, housing sections 66, 68 define respective passages 130, 132, which are aligned with each other when housing sections 66, 68 are secured together. Passages 130, 132 are further operable to maximize the exposed surface area of housing 26 subjected to air directed toward housing 26 by combination fan/flywheel member 30.

The construction of combination fan/flywheel member 30 is such that the majority of the mass of combination fan/flywheel member 30 is in outer ring section 124, to provide an efficient and effective means for maintaining inertia resulting from rotation of bicycle rear wheel 22. The provision of blade members 126 takes advantage of the existing need for a flywheel-type inertial member in a resistance unit, so as to prevent heat buildup and to enhance overall performance of the resistance unit. The movement of air onto housing 26 by combination fan/flywheel member 30 is especially advantageous when resistance unit 12 is operated at high speeds and/or for long periods of time, which can often result in the generation of a significant amount of heat within internal cavity 84. Dissipation of such heat by movement of air onto and through housing 26 significantly enhances the overall operation, performance and life of resistance unit 12.

Combination fan/flywheel member 30 is shown and described in combination with a fluid-type resistance mechanism. It is understood, however, that combination fan/flywheel member 30 may be used in connection with other types of resistance mechanisms, such as a magnetic or electronic resistance mechanism, for preventing the buildup of heat in the resistance mechanism and thereby enhancing overall performance, operation and life of the resistance mechanism. In addition, while the invention has been shown and described in connection with a bicycle trainer, it is understood that a combination fan/flywheel member such as 30 may be used in any type of exercise device incorporating a resistance mechanism or resistance unit, and is not limited to use in connection with a bicycle trainer. Other applications of resistance mechanisms of this type include stationary bicycles, rowing machines, stairstep exercise devices and the like, and a combination fan/flywheel member such as 30 may be employed in such devices for preventing buildup of heat in the resistance unit.

The drawings illustrate impeller 94 interconnected with roller 28 via shaft 56. It should be understood, however, that roller 28 and shaft 56 could be formed integrally with each other. In addition, impeller 94 may be interconnected with an input member, such as roller 28, by any connection arrangement or coupling arrangement which imparts rotation to impeller 94, such as a magnetic or fluid coupling or any satisfactory type of mechanical connection or coupling. Connection of impeller 94 to the input member, such as roller 28, is not limited to the specific embodiment utilizing a shaft such as 56, shown and described. Further, combination fan/flywheel member 30 may be in any satisfactory location in relation to housing 26 so as to move air relative to housing 26 during operation. For example, fan/flywheel member 30 may be located on the same side of the input member, such as roller 28, and may have blades oriented to move air forward and over housing 26, or oriented to draw warm air away from housing 26.

It can thus be appreciated that the invention provides a convenient, efficient and effective means for directing ambient air onto a resistance unit or resistance mechanism for preventing buildup of heat and avoiding the adverse effects associated with heat buildup. The invention provides a significant advantage in overall operation and life with little modification to existing components and associated structure.

Various alternatives and embodiments are contemplated as being within the scope of the following claims particularly pointing out and distinctly claiming the subject matter regarded as the invention.

I claim:

1. A resistance unit for an exercise device, comprising:

a support member;

a housing defining an interior and including structure engageable with the support member;

a shaft having a first portion extending into the interior of the housing and a second portion located exteriorly of the housing, wherein the shaft is interconnected in the exercise device so as to rotate in response to application of an external force by a person performing an exercise;

a resistance mechanism interconnected with the first portion of the shaft and located within the interior of the housing for resisting the external force;

a series of bearing members for rotatably supporting the shaft, comprising a pair of bearing members engaged with the support member at spaced locations and through which the shaft extends, and a third bearing member engaged with the housing; and an inertial member interconnected with the second portion of the shaft and rotatable therewith, wherein the inertial member includes a blade arrangement which is operable to move air toward the housing upon rotation of the inertial member by rotation of the shaft to dissipate heat from the housing.

2. A resistance unit for an exercise device, comprising:

a housing defining an interior;

an input member interconnected with the support member, wherein the input member is interconnected in the exercise device so as to rotate in response to application of an external force by a person performing an exercise;

a resistance mechanism interconnected with the input member and located within the interior of the housing for resisting the external force; and an inertial member interconnected with the input member and rotatable in response to movement of the input member therewith, wherein the inertial member includes a blade arrangement which is operable to move air toward the housing upon rotation of the inertial member by rotation of the input member shaft to dissipate heat from the housing.

3. The resistance unit of claim 2, wherein the input member is interconnected with a shaft having a first portion located in the interior of the housing and a second portion located exteriorly of the housing, wherein the input member is engaged with the second portion of the shaft.

4. The resistance unit of claim 3, wherein the input member comprises a roller member fixed to the shaft and located between the housing and the inertial member, wherein the roller member is adapted to engage a wheel of a bicycle for imparting rotation to the shaft in response to rotation of the bicycle wheel.

5. The resistance unit of claim 2, wherein the inertial member comprises a combination flywheel and fan member mounted to the second portion of the shaft.

6. The resistance unit of claim 5, wherein the combination flywheel and fan member includes a hub section engageable with the second portion of the shaft, an annular outer ring section located outwardly of the hub section, and wherein the blade arrangement is located between the hub section and the outer ring section.

7. The resistance unit of claim 6, wherein the blade arrangement comprises a series of blades extending between and interconnecting the hub section and the annular outer ring section, and wherein the blades are spaced apart from each other so as to define an open area between adjacent blades.

8. The resistance unit of claim 5, wherein the shaft extends along a longitudinal axis, and wherein the combination flywheel and fan member is spaced from the housing, wherein the blade arrangement is constructed and arranged so as to move air laterally in a direction parallel to the longitudinal axis of the shaft toward the housing.

9. The resistance unit of claim 8, further comprising an input roller member engaged with the second portion of the shaft and located between the housing and the combination flywheel and fan member, wherein the blade arrangement of the combination flywheel and fan member is operable to direct air past the input roller member toward the housing.

10. The resistance unit of claim 9, further comprising a support arrangement including a pair of support areas located one on either side of the input roller member, and wherein the shaft is rotatably engaged with the support arrangement by means of first and second bearing members, each of which is engaged with one of the support areas, and wherein the interior of the housing is adapted to receive a quantity of fluid and the housing includes a seal member through which the shaft extends into the interior of the housing, and further comprising a third bearing member located adjacent the seal and engaged with the housing for maintaining alignment of the shaft with the seal.

11. The resistance unit of claim 8, wherein the housing includes a series of fin members facing the combination flywheel and fan member, wherein air moved by the combination flywheel and fan member is directed onto the fin members for removing heat from the housing.

12. The resistance unit of claim 11, wherein the housing comprises a pair of housing sections secured together, wherein the majority of the fin members are formed on a first one of the housing sections which faces the combination flywheel and fan member when the housing sections are assembled together in the resistance unit.

13. A bicycle trainer, comprising:

a frame adapted to support a rear wheel of a bicycle; and a resistance unit mounted to the frame, including a housing; a rotatable input member adapted to rotate in response to rotation of the rear wheel of the bicycle; a resistance mechanism interconnected with the rotatable input member and located within the housing; and a rotatable inertial member interconnected with the rotatable input member and located exteriorly of the housing, wherein the inertial member includes blade structure which is operable upon rotation of the inertial member to direct air toward the housing.

14. The bicycle trainer of claim 13, wherein the rotatable input member comprises a roller member interconnected with a shaft, wherein the resistance mechanism and the inertial member are mounted to the shaft.

15. The bicycle trainer of claim 14, wherein the roller member is located between the resistance mechanism and the inertial member.

16. The bicycle trainer of claim 15, wherein the resistance unit is mounted to the frame by means of a support structure including a pair of support members, wherein a bearing is engaged with each support member and wherein the shaft extends through each bearing for rotatably supporting the shaft relative to the support members, and further comprising a bearing member engaged with the housing of the resistance unit for rotatably supporting the shaft relative to the housing.

17. The bicycle trainer of claim 14, wherein the inertial member comprises a combination flywheel and fan member including a hub section engageable with the shaft and an annular outer ring section spaced outwardly from the hub section, wherein the blade structure comprises a series of spaced apart blade members extending between and interconnecting the hub section with the annular outer ring section.

18. The bicycle trainer of claim 17, wherein the resistance mechanism comprises a fluid-type resistance mechanism located within an internal cavity defined by the housing, including a series of stationary blades located within the internal cavity, an impeller mounted to and rotatable with the shaft, and a quantity of fluid disposed within the internal cavity.

19. The bicycle trainer of claim 17, wherein the blade structure is constructed and arranged to direct air laterally toward the housing in a direction along a longitudinal axis defined by the shaft upon rotation of the combination flywheel and fan member.

* * * * *